United States Patent [19]

Kajihara et al.

[11] Patent Number: 4,665,344

[45] Date of Patent: May 12, 1987

[54] CERAMIC ENVELOPE DEVICE FOR HIGH-PRESSURE DISCHARGE LAMP

[75] Inventors: Takehiro Kajihara, Komaki; Senji Atsumi, Kakamigahara; Hirotsugu Izumiya, Nagoya, all of Japan

[73] Assignee: NGK Insulators, Ltd., Japan

[21] Appl. No.: 716,387

[22] Filed: Mar. 27, 1985

[30] Foreign Application Priority Data

Apr. 25, 1984 [JP] Japan ..... 59-62150[U]
Dec. 17, 1984 [JP] Japan ..... 59-191194[U]

[51] Int. Cl.[4] ..... H01J 61/30; H01J 61/35

[52] U.S. Cl. ..... 313/624; 313/625; 313/634; 313/635

[58] Field of Search ..... 313/624, 625, 623, 635, 313/634

[56] References Cited

U.S. PATENT DOCUMENTS 3,026,210 3/1962 Coble .
3,792,142 8/1970 Kobayashi et al. .
4,155,757 5/1979 Hing .
4,155,758 3/1979 Evans et al. .
4,507,584 3/1985 Coaton et al. ..... 313/624
4,539,511 9/1985 Denbigh et al. ..... 313/624

FOREIGN PATENT DOCUMENTS 1168291 5/1984 Canada ..... 313/623
0009352 4/1980 European Pat. Off. .
0000840 1/1982 Japan ..... 313/635

*Primary Examiner*—Palmer C. DeMeo
*Attorney, Agent, or Firm*—Parkhurst & Oliff

[57] ABSTRACT

A ceramic envelope device for a high-pressure metal-vapor discharge lamp, including a translucent ceramic tube, a pair of end caps closing opposite ends of the ceramic tube, and a pair of oppositely located discharge electrodes each of which is supported at a first end by the corresponding end cap such that a second end of the electrode protrudes from an inner surface of the corresponding end cap in the longitudinal direction of the ceramic tube. The end caps are electrically conductive, and completely covered at their inner surfaces with an electrical insulator.

13 Claims, 6 Drawing Figures

CERAMIC ENVELOPE DEVICE FOR HIGH-PRESSURE DISCHARGE LAMP

BACKGROUND OF THE INVENTION

The present invention relates in general to a ceramic envelope device for use in a high-pressure discharge lamp (hereinafter referred to as "HID lamp"; "HID" representing High Intensity Discharge), and more particularly to electrically conductive end caps or closure discs which close the opposite ends of a translucent ceramic tube which cooperates with the end caps to form a gas-tight envelope incorporated in a HID lamp.

In the art of such HID lamps using a translucent ceramic tube, a pair of electrically conducting discs are known as end caps to close the opposite open ends of the translucent ceramic tube. Examples of such closure end caps are illustrated in U.S. Pat. Nos. 4,155,757 and 4,155,758. Such end caps are formed of an electrically conducting cermet obtained by mixing, for example, particles of tungsten with particles of aluminum oxide, and sintering the mixture. These electrically conducting cermet end caps support a pair of tungsten electrodes at their inner surfaces of the ceramic envelope device so that the electrodes protrude from the inner surfaces of the end caps toward each other, i.e., longitudinally inwardly in the translucent ceramic tube. Also, electrical contact rods or lead rods are connected or fixed to the outer surfaces of the cermet end caps by suitable methods, so that electric power is applied to the pair of opposed tungsten electrodes through the contact rods and through the cermet end caps. Such cermet end caps have been advantageously employed, for example, in high-pressure sodium lamps, because they eliminate the need of using expensive metallic niobium. It is further recognized that such cermet end caps have been used also advantageously for so-called metal halide lamps which employ translucent ceramic tubes charged with a suitable metal halide together with mercury and rare gas, because the cermet exhibits relatively high corrosion resistance to metal halides.

However, such a HID lamp with a translucent ceramic tube closed by cermet end caps may suffer from a problem generally known as "arc-back" phenomenon wherein an arc will take place between the electrodes and the corresponding cermet end caps, rather than between the opposed electrodes, when the HID lamp is initially turned on. This arc-back phenomenon causes the cermet end caps to crack, thereby causing the translucent ceramic tube to leak. In addition, the "arc-back" phenomenon gives rise to vaporization and the scattering of refractory metal components in the cermet, and consequent deposition thereof on the inner surfaces of the ceramic tube, which results in blackening of the wall of the ceramic tube, thereby reducing its luminous flux.

It is also recognized that supersaturated metal halide in the ceramic tube may condense at the cold spot in the tube, i.e., at the lower end portion of the ceramic tube disposed vertically when the lamp is used in its upright position, whereby the cermet end caps closing the end portions of the tube are subject to corrosion due to the liquid phase of the condensed metal halide, with a result of failing to stably support the electrode in its upright posture, if the corrosion becomes severe.

SUMMARY OF THE INVENTION

The present invention, which was made in view of the above-discussed inconveniences experienced in the prior art, has as its principal object the provision of a ceramic envelope device for a high-pressure metal-vapor discharge lamp, which avoids the "arc-back" phenomenon between its electrodes and the corresponding end caps closing the opposite ends of its translucent ceramic tube, and wherein the electrodes are stably supported in position by the end caps for a long period of time.

According to the instant invention, there is provided a ceramic envelope device for use in a high-pressure discharge lamp, including a translucent ceramic tube, a pair of end caps closing opposite ends of the ceramic tube, and a pair of opposed discharge electrodes each of which is supported at its one end by the corresponding one of the end caps such that the other end of the electrode protrudes from an inner surface of the corresponding end cap in a longitudinally inward direction of the ceramic tube, characterized in that the end caps are electrically conductive, and are covered at their inner surfaces with an electrical insulator.

In the ceramic envelope for the high-pressure discharge lamp constructed as described above, the electrical insulators covering the inner surfaces of the corresponding end caps will effectively protect the ceramic envelope device against an "arc-back" phenomenon at the moment when the lamp is turned on. Therefore, the electrical insulators will serve to protect the end caps against damage due to such "arc-back" phenomenon, thus contributing to improvement in the operating reliability of the lamp. Further, the prevention of the "arc-back" trouble by the electrical insulators result in solving the conventionally experienced problem of blackening of the inner surface of the translucent ceramic tube, thereby assuring a high degree of luminous flux of the translucent ceramic tube.

In accordance with one embodiment of the invention, the end caps are made of a cermet which consists of a mixture of metal and non-metal materials, that is, a ceramic material containing a suitable proportion of metal as a separate phase. Preferably, the mixture may consist of 8–50% by weight of refractory metal such as tungsten or molybdenum, and the balance being aluminum oxide, i.e., alumina.

According to another embodiment of the invention, the electrical insulator is made of a refractory ceramic material selected from the group consisting of alumina, beryllia, spinel, boron nitride and glass frit.

In a further embodiment of the invention, the electrical insulator consists of a layer having a constant thickness as measured from the inner surface of the corresponding end cap. In this case, the thickness of the insulator layer is preferably held within a range of 0.05–0.8 mm.

According to a still further embodiment of the invention, the electrical insulator has a protruding portion protruding longitudinally inward in the ceramic tube so as to surround a part of the corresponding discharge electrode protruding from the inner surface of the corresponding end cap. The thickness of the protruding portion may be held within a range of 1.0–3.0 mm as measured from the inner surface of the corresponding end cap.

In the above embodiment, the protruding portion of the electrical insulator causes a liquid phase of a metal halide to be condensed near the end caps away from the exposed end portion of the high temperature discharging electrode, whereby the central portion of the end cap around the fixed end of the electrode is protected against exposure to the liquid metal halide and against consequent corrosion thereof. Hence, the protruding portion of the electrical insulator overcomes the conventional failure of the end cap to stably support the electrode.

In one form of the above embodiment, the protruding portion of the electrical insulator is positioned at a radially central part of the corresponding end cap, and has a central bore through which the corresponding discharge electrode extends. In this instance the electrical insulator may have an annular peripheral portion of a constant thickness from which the central protruding portion protrudes. The central protruding portion of the electrical insulator may have a variable-diameter part which has a thickness increasing in a radially inward direction toward the central bore formed therein, as measured from the inner surface of the corresponding end cap. For example, the central protruding portion may be formed in a substantially frustoconical shape.

It is possible that the end cermet cap has a central protruding part which protrudes from the inner surface thereof. In this case, the central protruding part is covered with the central protruding portion of the electrical insulator.

BRIEF DESCRIPTION OF THE DRAWINGS

The foregoing and other objects, features and advantages of the invention will be apparent from reading the following description of illustrative embodiments taken in conjunction with the accopanying drawings, in which.

DETAILED DESCRIPTION OF THE PREFERRED EMBODIMENTS

To further clarify the present invention, preferred embodiments of the invention will be described in detail with reference to the accompanying drawings.

Figure 1:
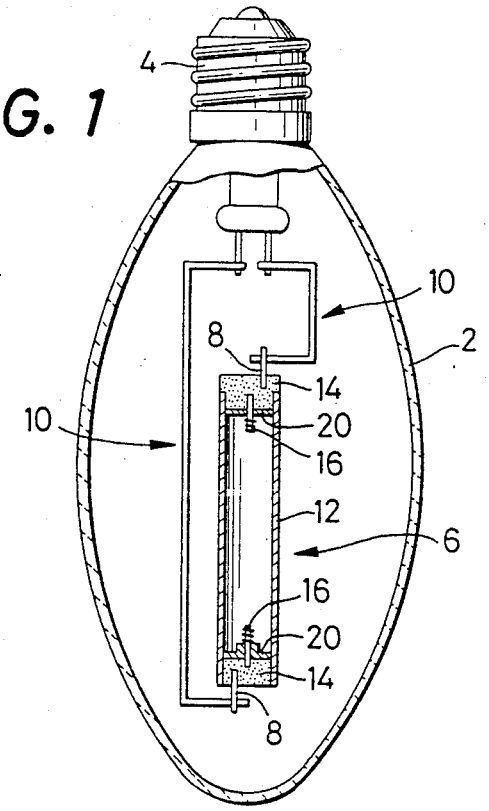
FIG. 1 is a schematic elevational view partly in cross section of an example of a HID lamp incorporating one embodiment of a ceramic envelope device of the invention which includes a translucent ceramic tube and end caps closing the opposite ends of the tube.

Referring first to FIG. 1, there is schematically illustrated a complete assembly of a HID lamp which incorporates one preferred embodiment of a ceramic envelope device 6 of the invention which will be described. In the figure, reference numeral 2 designates a bulbiform translucent jacket which is generally made of glass or similar material. This translucent jacket 2 is closed at its open end by a base 4. The jacket 2 and the base 4 cooperate to form a gas-tight enclosure which is charged with a suitable inert gas such as nitrogen, or maintained under vacuum. As is well known in the art, electric power applied to the base 4 is supplied, via electrical conductor members 10, 10, to electrically conductive lead members in the form of electrical contact rods 8, 8 which are disposed at the opposite ends of the ceramic envelope device 6 accommodated in the translucent jacket 2.

The ceramic envelope device 6 includes a translucent ceramic arc tube 12 and a pair of closure discs in the form of end caps 14, 14 which are secured to the opposite ends of the ceramic arc tube 12 such that the end caps 14, 14 close the opposite ends of the arc tube 12 so as to maintain gas-tightness of the ceramic envelope 6. The translucent ceramic arc tube 12 is a tubular member made of alumina or other ceramic materials as disclosed in U.S. Pat. Nos. 3,026,210 and 3,792,142. The end caps 14, 14 are formed from an electrically conductive cermet. The ceramic arc tube 12 of the gas-tight ceramic envelope device 6 is charged with a suitable gas, and suitable metal or its compound which is selected depending upon the specific type of the HID lamp, from the standpoint of radiant efficiency, color-rendering properties, etc. In the case of a high-pressure sodium lamp, for example, the arc tube 12 is charged with metallic sodium, mercury and rare gas. In a metal halide lamp, the arc tube 12 is charged with a metal halide (such as dysprosium iodide, thallium iodide, sodium iodide, indium iodide, etc.), together with mercury and rare gas.

Figure 2:
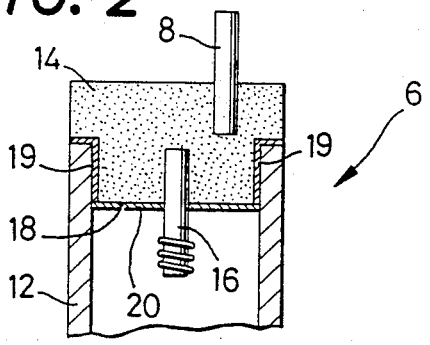
FIG. 2 is a fragmentary view partly in cross section, showing in enlargement one end portion of the envelope device of the HID lamp of FIG. 1.

The subject matter of the invention is particularly related to the electrically conducting end caps 14, 14 which serve as closure members for the translucent arc tube 12. As illustrated in FIG. 2 on an enlarged scale, each end cap 14 is fitted in the corresponding end of the arc tube 12 and is fixed thereto with a sealing layer 19 of glass frit or similar material. The contact rod 8 is embedded at its one end in the outer portion of the end cap 14, such that the other end of the rod 8 protrudes outwardly from the outer surface of the end cap 14. Also, a known electrode 16 of tungsten or other metal is similarly embedded at its one end in the inner portion of the end cap 14, such that the other end of the electrode 16 protrudes from the inner surface 18 of the end cap 14 longitudinally inward in the translucent arc tube 12. The electrode 16 is positioned at a radially central part of the end cap 14 (arc tube 12). The inner surface 18 from which the electrode 16 protrudes is wholly covered with an electrical insulator in the form of an insulating layer 20 of a suitable constant thickness.

These insulating layers 20, 20 covering the inner surfaces 18 of the electrically conductive end caps 14, 14, serve to effectively prevent an "arc-back" phenomenon which is an electrical discharge between the electrode 16 and the corresponding inner surface 18 upon application of a voltage between the opposed electrodes 16, 16 through the contact rods 8, 8 at the moment when the HID lamp is turned on. Namely, the insulating layers 20 permit normal arcing between the opposed ends of the discharge electrodes 16. Therefore, it is possible to prevent the conventionally experienced troubles of cracking and consequent leaking of the envelope device 6 at the end caps (14, 14) due to the "arc-back" phenomenon, and to avoid vaporization and scattering of refractory metal of the cermet end caps (14, 14). Accordingly, the insulating layers 20, 20 make it possible to solve the conventionally encountered problem of blackening of the inner surface of the translucent arc tube 12 due to deposition of the refractory metal, and thereby overcome the resulting problem of reduced luminous flux of the arc tube 12.

The electrically conductive end caps 14, 14 closing the translucent ceramic arc tube 12 of the ceramic envelope device 6 are formed of suitable known electrically conductive materials having a coefficient of thermal expansion which is intermediate between that of the material of the translucent ceramic arc tube 12, and that of the refractory metal of the electrodes 16, 16 and contact rods 8, 8. For example, composite materials of metallic tungsten or molybdenum and aluminum oxide, or tungsten carbide, tungsten boride, or the like may be suitably used for the end caps 14, 14. In particular, it is recommended to use a cermet which is a composite material of a non-metallic material, and a metal which is variable in refractoriness (heat resistance), corrosion resistance, thermal expansion coefficient and electric resistance by changing its composition. Preferably, th cermet consists of a 8–50% by weight of refractory metal such as tungsten and molybdenum, and the balance being aluminum oxide. The cermet containing not more than 8% by weight of a metallic material is excessively high in electrical resistance, while the cermet containing the same in an amount exceeding 50% by weight can not be a sufficiently densified body, and renders the end caps 14, 14 poor in gastightness.

The insulating layers 20, 20 are provided to cover the inner surfaces 18, 18 of the end caps 16 on the side of the electrodes 16, 16, and are made of known suitable electrically insulating materials, preferably refractory and electrically insulating ceramics having a thermal expansion coefficient close to that of the material of the end caps 14, 14. For example, the insulating layers 20, 20 are made of alumina, beryllia, spinal, boron nitride, or glass frit. These layers 20, 20 are formed by a suitable known processes. For instance, they are molded and sintered simultaneously as an integral part of the end caps 14, 14, or formed by applying a coating of a selected insulating material to the pre-sintered material of the end caps 14, 14 with a glass-frit sealing layer, or by thermal spraying, vapor deposition or another suitable method.

While at least the inner surface 18 of each end cap 14 must be covered with the insulating layer 20 according to the invention, it is possible to cover all surfaces of the end cap 14 with the insulating layer 20. The thickness of the insulating layers 20 is selected within a range that meets the object of this invention, i.e., so as to achieve effective restraint of the "arc-back" phenomenon. Generally, the insulating layers 20 are formed with an approximate thickness of 0.05–0.8 mm.

Figure 3:
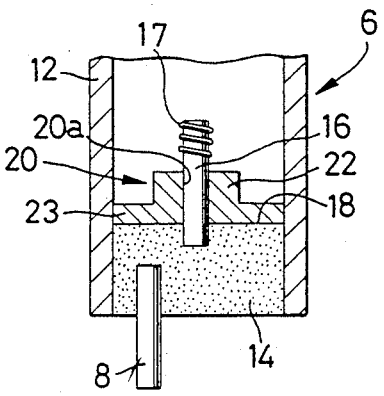
FIGS. 3–6 are views corresponding to FIG. 2, illustrating modified embodiments of the invention.

Referring to FIG. 3, there is illustrated another embodiment of the ceramic envelope device 6, wherein electrically conductive end caps 14, 14 are fixedly fitted into the opposite ends of a translucent ceramic arc tube 12, by shrinkage of the arc tube 12 during a sintering process. A contact rod 8 is embedded at its one end in the outer portion of the end cap 14, such that the other end of the rod 8 protrudes outwardly from the outer surface of the end cap 14. Also, a known electrode 16 of tungsten or another metal is similarly embedded at its one end in the inner portion of the end cap 14, such that the other end of the electrode 16 protrudes from an inner surface 18 of the end cap 14 in the longitudinally inward direction of the translucent arc tube 12. The electrode 16 is positioned at a radially central part of the end cap 14 (arc tube 12). The inner surface 18 from which the electrode 16 protrudes is wholly covered with an electrically insulating layer 20. In this modified embodiment, at least the insulating layer 20 for the lower end cap 14 (the lower one when the lamp is oriented upright as shown in FIG. 1) has a central protruding portion 22 which protrudes, longitudinally inward in the ceramic arc tube 12, so as to surround a longitudinally intermediate part of the centrally located discharge electrode 16 which protrudes from the inner surface 18 of the corresponding (lower) end cap 14. Stated more specifically, the central protruding portion 22 protrudes from an annular peripheral portion 23 of the layer 20, and has a thickness greater than that of the peripheral portion 23, as measured from the inner surface 18 of the end cap 14. The discharge electrode 16, which is embedded over a suitable length in the corresponding end cap 14, extends through a central bore 20*a* formed in the insulating layer 20.

In the ceramic envelope device 6 described above, the centrally protruding insulating layers 20 covering the inner surfaces 18 of the end caps 14 are effective to prevent an "arc-back" phenomenon which is an electrical discharge between the electrode 16 and the inner surface 18 upon application of a voltage between the opposed electrodes 16, 16 through the contact rods 8, 8 at the moment when the HID lamp is turned on. That is, the insulating layers 20 permit normal arcing between the opposed ends of the discharge electrodes 16, making it possible to prevent the conventionally experienced troubles of cracking and consequent leaking at the end caps (14, 14) due to the "arc-back" phenomenon, and to avoid vaporization and scattering of refractory metal of the cermet end caps (14, 14). Accordingly, the insulating layers 20, 20 capable of solving the conventionally encountered problem of blackening of the inner surface of the translucent arc tube 12 due to deposition of the refractory metal, and thereby overcoming the resulting problem of reduced luminous flux of the arc tube 12.

Furthermore, the central protruding portion 22 of the insulating layer 20 of the lower end cap 14 causes a liquid phase of a metal halide to be condensed in the vicinity of the end cap 14 away from the exposed end portion of the discharge electrode, whereby the portion of the cermet end cap 14 around the fixed end of the electrode is protected against exposure to the liquid metal halide and consequent corrosion thereof. Hence, the conventional failure of the end cap 14 to stably support the electrode 16 is effectively avoided.

Figure 4:
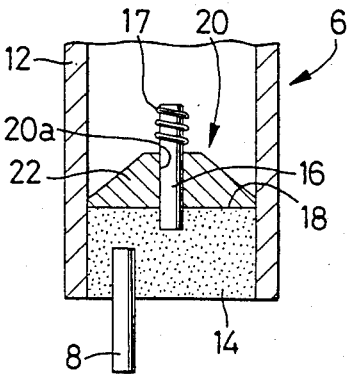

Although the central protruding portion 22 of the insulating layer 20 of the embodiment of FIG. 3 is provided as a stepped portion which protrudes from the annular peripheral portion 23, it is possible that the insulating layer 20 be formed in a frusto-conical shape as shown in FIG. 4, so that its thickness increases in a radially inward direction toward the electrode 16, that is, toward the central bore 20*a*, as measured from the inner surface 18 of the end cap 14. In this case, therefore, the central portion of the insulating layer 20 has a variable-diameter part whose diameter decreases as it protrudes from the inner surface 18.

The thickness of the peripheral portion of the insulating layer 20 of FIGS. 3 and 4 is selected within a range so as to effectively restrain the "arc-back" phenomenon, generally within an approximate range of 0.05–0.8 mm, as previously indicated in connection with the insulating layer of FIG. 2. On the other hand, the thickness of the central protruding portion surrounding the intermediate part of the electrode 16 is determined to fall within a range of 1.0–3.0 mm, in order to protect the exposed portion of the electrode 16 against exposure to the condensed metal halide, and to thereby protect the central portion of the end cap 14 around the fixed end of the electrode 16. However, the thickness of the central protruding portion should be determined so that the top of the protruding portion 22 will not contact a coil 17 wound on the exposed portion of the electrode 16.

The closure end caps 14 covered with the insulating layers 20 which have been described hitherto, are suitably applicable to a translucent ceramic tube (12) used in HID lamps such as metal halide lamps and high pressure sodium lamps.

Figure 5:
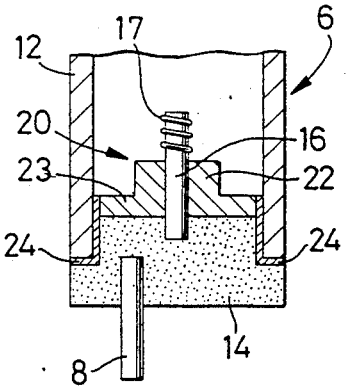

While the end caps 14 of FIGS. 3 and 4 are secured to the ceramic arc tube 12 by shrinkage of the latter during sintering, it will be obvious that the end caps 14 may be fixed with a sealing layer 24 of glass frit as illustrated in FIG. 5, like the sealing layer 19 of FIG. 2.

Figure 6:
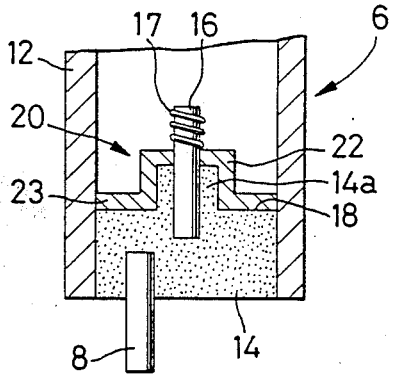

In the preceding embodiments of FIGS. 3–5, the portion of the insulating layer 20 around the discharge electrode 16 is made thicker than the remaining peripheral portion, so as to surround the intermediate portion of the electrode 16. While this arrangement is preferred in this invention, it is appreciated that the portion of the end cap 14 from which the electrode 16 extends, be formed so as to protrude from the inner surface 18 toward the exposed end of the electrode 16, in the form of a stepped portion or a frusto-conical portion. In this case, the protruding portion of the end cap 14 is covered with or accommodated in the protruding portion 22 of the insulating layer 20. FIG. 6 shows an example of such a modified end cap 14 which has a stepped central protruding portion 14a which is covered with the central protruding portion 22 of the insulating layer 20 which has the same thickness as the peripheral portion 23.

While the present invention has been illustrated in its preferred embodiments, it is to be understood that the invention is not limited by the details of description of construction and arrangement, and that it is intended to cover all changes, modifications and improvements which are obvious to those skilled in the art, and which do not affect the spirit of the invention nor exceed the scope thereof as expressed in the appended claims.

What is claimed is:

1. A ceraamic envelope device for a high-pressure metal-vapor discharge lamp, comprising a translucent ceramic tube, a pair of end caps closing opposite ends of the ceramic tube, a pair of oppositely located discharge electrodes each of which is supported at a first end by a corresponding end cap such that a second end of each electrode protrudes from an inner surface of the corresponding end cap in a longitudinally inward direction in the ceramic tube, said end caps being electrically conductive and said inner surface of each of said end caps being completely covered with an electrical insulator, said electrical insulator on at least one of said pair of end caps including a protruding portion which protrudes longitudinally inward in said ceramic tube, said protruding portion of the electrical insulator surrounding at least a portion of the electrode which protrudes from the inner surface of said at least one end cap.

2. A ceramic envelope device as claimed in claim 1, wherein said end caps comprise a cermet material which consists essentially of a mixture of metal and non-metal materials.

3. A ceramic envelope device as claimed in claim 2, wherein said cermet material consists essentially of 8–50% by weight of a refractory metal, and a balance being aluminum oxide.

4. A ceramic envelope device as claimed in claim 3, wherein said refractory metal consists essentially of a metal selected from the group consisting of tungsten and molybdenum.

5. A ceramic envelope device as claimed in claim 1, wherein said electrical insulator comprises a refractory ceramic material selected from the group consisting of alumina, beryllia, spinel, boron nitride, and glass frit.

6. A ceramic envelope device as claimed in claim 1, wherein said electrical insulator comprises a layer having a constant thickness as measured from said inner surface of the corresponding end cap.

7. A ceramic envelope device as claimed in claim 6, wherein said layer has a thickness of 0.05–0.8 mm.

8. A ceramic envelope device as claimed in claim 1, wherein said protruding portion has a thickness of 1.0–3.0 mm as measured from the inner surface of the corresponding end cap.

9. A ceramic envelope device as claimed in claim 1, wherein said protruding portion of the electrical insulator is positioned at a radially central part of the corresponding end cap, and has a central bore through which the corresponding discharge electrode extends.

10. A ceramic envelope device as claimed in claim 9, wherein said electrical insulator includes an annular peripheral portion having a constant thickness from which the central protruding portion protrudes.

11. A ceramic envelope device as claimed in claim 9, wherein said protruding portion has a variable-diameter part which has a thickness which increases in a radially inward direction toward said central bore, as measured from the inner surface of the corresponding end cap.

12. A ceramic envelope device as claimed in claim 11, wherein said protruding portion comprises a substantially frustoconical shape.

13. A ceramic envelope device as claimed in claim 9, wherein said corresponding end cap includes a central protruding part which protrudes from said inner surface thereof and which is covered with the central protruding portion of said electrical insulator.

* * * * *